United States Patent [19]

Sprinkel, Jr.

[11] Patent Number: 4,699,158

[45] Date of Patent: Oct. 13, 1987

[54] ADJUSTABLE FILTER CIGARETTE WITH TACTILE INDICATOR

[75] Inventor: Francis M. Sprinkel, Jr., Glen Allen, Va.

[73] Assignee: Philip Morris Incorporated, New York, N.Y.

[21] Appl. No.: 853,143

[22] Filed: Apr. 17, 1986

[51] Int. Cl.[4] ..... A24D 3/04

[52] U.S. Cl. ..... 131/336; 131/338; 131/198.2

[58] Field of Search ..... 131/306, 338, 361, 365, 131/198.1, 198.2, 178

[56] References Cited

U.S. PATENT DOCUMENTS

| | | | |
|---|---|---|---|
| 1,974,242 | 9/1934 | Jordan, Jr. et al. | 131/198.2 |
| 2,954,035 | 9/1960 | Saffir | 131/338 |
| 2,967,528 | 1/1961 | Kelter | 131/198.2 |
| 3,116,741 | 1/1964 | Speck | 131/187 |
| 3,270,751 | 9/1966 | Tucker | 131/198.2 |
| 3,359,988 | 12/1967 | Thomson | 131/10.3 |
| 3,376,874 | 4/1968 | Kim et al. | 131/207 |
| 3,409,019 | 11/1968 | Chun | 131/10.7 |
| 3,428,050 | 2/1969 | Kandel | 131/338 |
| 3,463,166 | 8/1969 | Bennett et al. | 131/178 |
| 3,503,406 | 3/1970 | Riegel et al. | 131/10 |
| 3,512,537 | 5/1970 | Pelletier | 131/9 |
| 3,608,561 | 9/1971 | Dock | 131/10 A |
| 3,713,452 | 1/1973 | D'Elia et al. | 131/198 A |
| 4,254,782 | 3/1981 | Ligeti | 131/187 |
| 4,526,183 | 7/1985 | Nichols et al. | 131/336 |
| 4,527,573 | 7/1985 | Hausermann | 131/336 |
| 4,532,943 | 8/1985 | Nichols et al. | 131/336 |

FOREIGN PATENT DOCUMENTS

| | | |
|---|---|---|
| 0105682 | 4/1984 | European Pat. Off. . |
| 1446472 | 8/1976 | United Kingdom . |

*Primary Examiner*—V. Millin
*Assistant Examiner*—H. Macey
*Attorney, Agent, or Firm*—Jeffrey H. Ingerman

[57] ABSTRACT

An adjustable filter cigarette is provided with detents for tactile indication of the degree of adjustment. The detents include a protuberance on the surface of the filter mating with cutouts in the tipping paper, or a protuberance on the inside of the tipping paper mating with depressions on the surface of the filter.

7 Claims, 3 Drawing Figures

ADJUSTABLE FILTER CIGARETTE WITH TACTILE INDICATOR

BACKGROUND OF THE INVENTION

This invention relates to filter cigarettes. More particularly, this invention relates to filter cigarettes which are adjustable to vary one or more characteristics of the cigarette.

It is known to provide filter cigarettes which have rotatable elements associated with their filters for varying characteristics of the cigarette such as filtration, resistance-to-draw, air dilution, and amount of added flavorant. For example, commonly-assigned U.S Pat. No. 4,532,943, which is hereby incorporated by reference in its entirety, shows a filter cigarette in which the filter is divided into a mouth-end segment and a rod-end segment which are axially connected for relative rotation. In one embodiment, tipping paper attached to one segment overlies but is not attached to the other segment. This overlying portion of tipping paper has an opening which overlies a corresponding opening in the plug wrap of the other, overlain segment. As the two segments rotate relative to one another, the two openings move into and out of registry, varying the air dilution value of the cigarette. In other embodiments, the relative rotation of the filter segments ruptures a flavorant capsule to release flavorant, or moves longitudinal bores in the segments into and out of registry, varying the resistance-to-draw of the cigarette.

Copending, commonly-assigned application Ser. No. 853,049, filed concurrently herewith, shows a filter cigarette in which the wrapped filter plug is slidable in a sleeve of tipping paper attached to the cigarette rod, or in which the wrapped filter plug is mounted in a sleeve which is slidable on the cigarette rod. Cooperating bands affixed to the sleeve and the filter plug in the former case, or to the sleeve and the cigarette rod in the latter case, prevent the removal of the filter plug from the cigarette. This arrangement can be used simply to allow a smoker to vary the length of the cigarette, or in combination with openings that move in and out of registry to vary the air dilution value of the cigarette, or in combination with encapsulated favorants to vary the amount of added flavorant in the cigarette.

Other cigarettes of this type—in which elements move either rotationally or axially to control characteristics of the cigarette—are known. In some of these cigarettes, particularly some of those of the rotational type, the physical construction of the rotatable element is such that it can be rotated continuously. A smoker therefore cannot determine the degree of adjustment of the cigarette without looking at the indicia which are usually printed on the cigarette. In other adjustable cigarettes of the rotational type, and all adjustable cigarettes of the axially translating type, the physical construction limits the movement of the adjustable element to a particular range. However, a smoker still cannot determine where within the range the cigarette is adjusted without looking at the visual indicia.

A smoker may desire to adjust the cigarette without having to look at it. In particular, because mass-produced cigarettes all come from the pack in the same state of adjustment, a smoker may know from experience that the cigarette has to be adjusted a particular amount in one direction or another to suit the smoker's individual preference. It therefore would be desirable to provide an adjustable cigarette having a tactile indicator of the degree of adjustment.

SUMMARY OF THE INVENTION

It is an object of this invention to provide an adjustable cigarette having a tactile indicator of the degree of adjustment.

It is also an object of this invention to provide a cigarette which can be adjusted by the smoker without looking.

In accordance with this invention, a filter cigarette is provided having a substantially cylindrical tobacco rod and a substantially cylindrical filter assembly having substantially the same cross-sectional area and shape. The filter assembly has an adjustable element for varying at least one characteristic of the cigarette. Detent means provides a tactile indication of the position of the adjustable element.

In one embodiment, the filter assembly comprises a wrapped, substantially cylindrical filter plug and tipping paper circumscribing the filter plug. At least a portion of the tipping paper or of the filter plug is movable relative to the other in a particular direction to vary at least one characteristic of the cigarette. The detent means comprises at least one protuberance on one of the relatively movable elements and a corresponding plurality of receiving sites on the other element.

In a method of manufacturing the cigarette, the tobacco rod and the filter assembly are brought into abutting axial alignment. A strip of tipping paper for adheringly wrapping about the filter assembly and a portion of the tobacco rod is provided, the relatively movable elements having already been formed in the filter plug and the tipping paper. The protuberance is formed on one of the relatively movable elements, and receiving sites are formed on the other of the relatively movable elements. The strip of tipping paper is then adheringly wrapped about the filter assembly and a portion of the tobacco rod.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
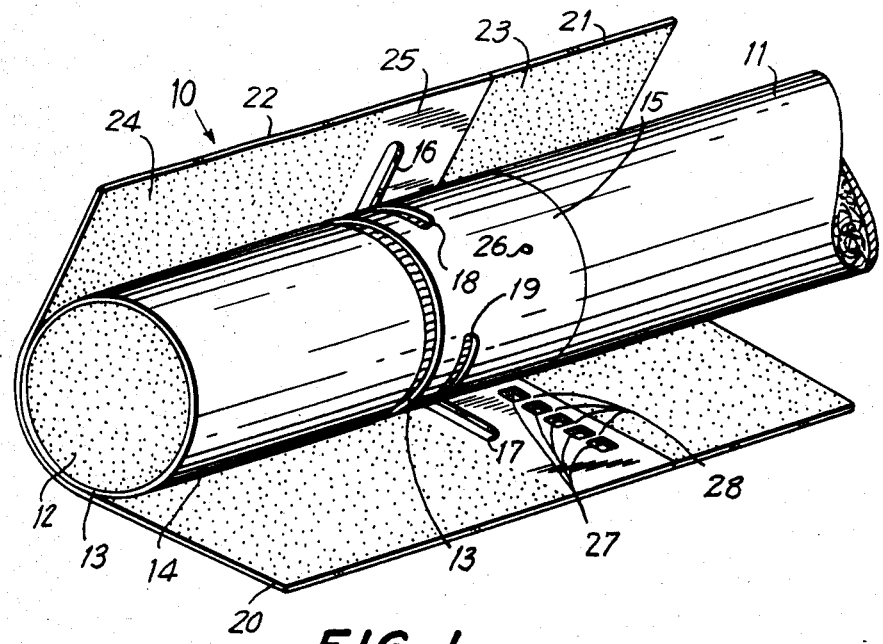
FIG. 1 is a fragmentary, partially exploded perspective view taken from the mouth end of one embodiment of a cigarette according to this invention.
Figure 2:
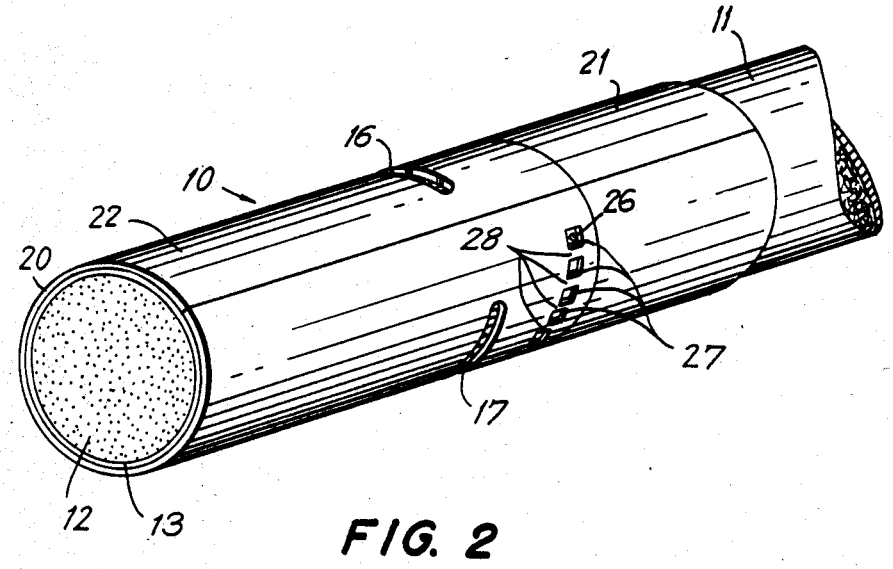
FIG. 2 is a fragmentary perspective view, not exploded, of the cigarette of FIG. 1.

A first embodiment 10 of a cigarette according to this invention is shown in FIGS. 1 and 2. Tobacco rod 11, which is a charge of tobacco wrapped in cigarette paper, is in abutting axial alignment with filter plug 12. Filter plug 12 is circumscribed by plug wrapping 13 and is divided into mouth-end segment 14 and rod-end segment 15. Segments 14, 15 are axially joined for relative rotation about the longitudinal axis of cigarette 10. Tobacco rod 11 and filter plug 12 are circumscribed by tipping paper 20, which is divided into rod-end section 21 and mouth-end section 22. Rod-end tipping section 21 is fixed by adhesive band 23 to both rod-end filter segment 15 and tobacco rod 11, thereby attaching filter plug 12 to tobacco rod 11. Mouth-end tipping section 22 is fixed to mouth-end filter segment 14 by adhesive band 24, and extends over, but is not fixed to, rod-end filter segment 15 at 25. Therefore, when mouth-end filter segment 14 is rotated relative to rod-end filter segment 15, the overextending portion 25 of mouth-end tipping section 22 moves relative to wrapped rod-end filter segment 15 beneath it. This construction is described in detail in above-incorporated U.S. Pat. No. 4,532,943, which shows adapting this cigarette construction to vary air dilution, resistance-to-draw, or amount of added flavorant.

As shown in FIG. 1, cigarette 10 is adapted to vary air dilution. Openings 16, 17 are provided in overextending portion 25 of mouth-end tipping section 24. Corresponding openings 18, 19 in plug wrapping 13 of rod-end filter segment 15 underlie openings 16, 17. As mouth-end filter segment 14 is rotated relative to rod-end filter segment 15, the degree of registry between openings 16, 18 and 17, 19 varies, admitting varying amounts of air to filter plug 12.

In the construction shown in FIG. 1, relative rotation of the filter segments 14, 15 beyond the point of maximum deregistry of openings 16, 18 and 17, 19 will cause increasing reregistry of the openings. Therefore, relative rotation of the filter segments is preferably limited to a range of approximately 90°. In fact, in some embodiments of said above-incorporated patent, the relative rotation mechanism is structurally limited in range. For these reasons, the detent means of this invention as applied to FIG. 1 is shown as being effective only for a limited range. However, in continuously rotatable cigarettes the detent means would also be continuous.

One embodiment of the detent means of this invention includes protuberance 26 on filter segment 15 and receiving sites, such as cutouts 27, in overextending tipping paper portion 25. Protuberance 26 is preferably formed by depositing a thermoplastic material on the surface of filter segment 15, although any type of substance that hardens into a non-tacky mass can be used. Other means for providing protuberance 26 may also be devised. A plurality of cutouts 27 is provided, corresponding in axial position to protuberance 26, so that protuberance 26 moves from cutout to cutout during relative rotation of filter segments 14, 15. Detent action is provided as protuberance 26 successively encounters the resistance of tipping paper areas 28 between the cutouts 27.

Although only one protuberance 26 is shown, a plurality of protuberances 26 can be provided. However, if more than one protuberance is provided, and the cutouts do not extend completely around the cigarette, the number of cutouts should exceed the number of protuberances by at least one, so that there are at least two positions of adjustment of cigarette 10. The width of a protuberance 26, and of a cutout 27, is preferably from about 0.5 mm to about 2 mm. The number of cutouts 27 in a given range, whether or not that range encompasses the entire circumference of the cigarette as discussed above, is limited by the size of the range and by the need to have a minimum amount of material in areas 28 so that they do not tear on the passing of protuberance 26.

Figure 3:
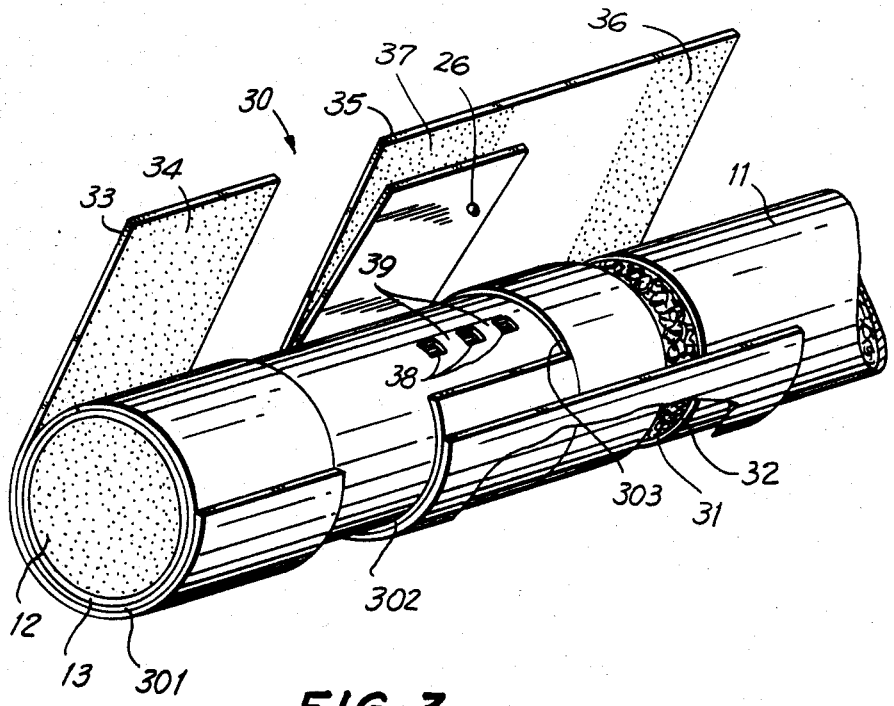
FIG. 3 is a fragmentary, partially exploded perspective view taken from the mouth end of another embodiment of a cigarette according to this invention.

A second embodiment 30 of a cigarette according to this invention is shown in FIG. 3. Cigarette 30, as shown, is based on the cigarette described in said above-identified copending application Ser. No. 853,049, filed concurrently herewith having a longitudinally movable filter element. Cigarette 30 includes a tobacco rod 11 including a charge of tobacco 31 in cigarette paper 32 and an axially aligned filter plug 12 circumscribed by plug wrapping 13. Three bands 301, 302 and 303 circumscribe the wrapped filter plug in sequence. First and third bands 301, 303 are adhered to plug wrapping 13, but second band 302 is not, and so is slidable relative to filter plug 12. A first tipping paper section 33 circumscribes and is adhered to first band 301 by adhesive band 34. A second tipping paper section 35 is adhered to tobacco rod 11 by adhesive band 36 and to second band 302 by adhesive band 37. Second tipping paper section 35 and second band 302 thus form a sleeve in which filter plug 12 is slidable relative to tobacco rod 11, with bands 301, 303 serving as stops to limit the range of travel of filter plug 12. As shown, cigarette 30 is constructed for variable length only, but it could be constructed to vary air dilution or other characteristics as well.

The detent means of cigarette 30 includes protuberance 26 on the inner surface of second band 302 and a corresponding plurality of depressions 38 in the surface of filter plug 12. Protuberance 26 moves from depression to depression during sliding of filter plug 12. Detent action is provided as protuberance 26 successively encounters the resistance of filter material in areas 39 between depressions 38. As in cigarette 10, more than one protuberance 26 can be provided, as long as the number of depressions 38 exceeds the number of protuberances by at least one. Also, as in cigarette 10, protuberance 26 is preferably formed by depositing a substance which hardens into a non-tacky mass. Depressions 38 can be formed by embossing filter plug 12, either with or without heat, or by cutting the depressions into filter 12. Again the preferred size of protuberances 26 and depressions 38 is from about 0.5 mm to about 2 mm, and depressions 38 should be spaced far enough apart that the intervening area 39 of filter material will not be broken by protuberance 26.

Although the circumferential detent means of cigarette 10 is shown as having the protuberance facing outward from the filter plug through cutouts in the tipping paper, and the longitudinal detent means of cigarette 30 is shown as having the protuberance facing inward from the tipping paper toward the depressions in the filter plug, either type of construction can be used on either rotationally or axially adjustable cigarettes. Further, it is to be understood that detent means according to this invention can be used with any type of adjustable cigarette which lends itself to the type of detent construction shown, and not only with the two types of adjustable cigarettes shown.

Thus, an adjustable cigarette is provided having a tactile indication of the degree of adjustment. Such a cigarette can be adjusted by a smoker who is familiar with it without resort to visual indicia. One skilled in the art will appreciate that the present invention can be practiced in other than the embodiments shown, which are presented for purposes of illustration and not of limitation, and the present invention is limited only by the claims which follow.

What is claimed is:

1. A filter cigarette, comprising:

a substantially cylindrical tobacco rod; and a substantially cylindrical filter assembly, said filter assembly and said tobacco rod having substantially the same cross-sectional area and shape, said filter assembly having an adjustable element movable within a range of adjustability for varying at least one characteristic of said cigarette; and detent means for providing a tactile indication of the position of said adjustable element throughout said range of adjustability.

2. The filter cigarette of claim 1 wherein said filter assembly comprises a wrapped, substantially cylindrical filter plug and tipping paper circumscribing said filter plug, one of at least a portion of said filter plug and at least a portion of said tipping paper being movable relative to the other in a particular direction to vary said at least one characteristic, said detent means comprising:

at least one protuberance on one of said relatively movable elements, and a corresponding plurality of receiving sites on the other of said relatively movable elements;

said protuberances and said receiving sites being aligned along the direction of relative motion.

3. The filter cigarette of claim 2 wherein said protuberance is on said at least a portion of said filter plug, and said at least a portion of said tipping paper has holes formed therein, said holes being said receiving sites.

4. The filter cigarette of claim 2 wherein said protuberance is on said at least a portion of said tipping paper, and said at least a portion of said filter plug has depressions embossed thereon, said depressions being said receiving sites.

5. The filter cigarette of claim 2 wherein said protuberance comprises a discrete hardened deposit of a thermoplastic material.

6. The filter cigarette of claim 2 wherein said relatively movable elements are relatively longitudinally movable, said protuberance and said receiving sites extending parallel to the longitudinal axis of said cigarette.

7. The filter cigarette of claim 2 wherein said relatively movable elements are relatively rotationally movable, said protuberance and said receiving sites extending circumferentially about said cigarette.

* * * * *